US008827123B2

(12) United States Patent
Mainville et al.

(10) Patent No.: US 8,827,123 B2
(45) Date of Patent: Sep. 9, 2014

(54) DISPENSER FOR FOOD DRESSING

(75) Inventors: Patrick Mainville, Montreal (CA); Benoit Orban, St-Lambert (CA); Maxime Langlois, Montreal (CA)

(73) Assignee: Trudeau Corporation 1889 Inc., Boucherville, Quebec (CA)

( * ) Notice: Subject to any disclaimer, the term of this patent is extended or adjusted under 35 U.S.C. 154(b) by 130 days.

(21) Appl. No.: 13/035,333

(22) Filed: Feb. 25, 2011

(65) Prior Publication Data

US 2012/0048896 A1 Mar. 1, 2012

Related U.S. Application Data

(60) Provisional application No. 61/308,614, filed on Feb. 26, 2010.

(51) Int. Cl.
*B65D 47/06* (2006.01)
*B65D 81/32* (2006.01)

(52) U.S. Cl.
CPC ..... *B65D 47/06* (2013.01); *B65D 81/3227* (2013.01)
USPC ..... 222/481.5; 222/478; 222/571; 222/566; 222/567; 222/572; 222/570

(58) Field of Classification Search
CPC .... B65D 47/32; B65D 25/465; B65D 47/066; B65D 47/0838; B65D 51/24; A47J 47/01
USPC ..... 222/481.5, 478, 571, 567, 129, 152, 222/173, 182, 192, 464.1, 375, 540, 569, 222/572, 271; 239/103
See application file for complete search history.

(56) References Cited

U.S. PATENT DOCUMENTS

| | | | | | |
|---|---|---|---|---|---|
| 1,436,708 | A * | 11/1922 | Goebel | ..... | 222/478 |
| 1,509,360 | A * | 9/1924 | Lewis | ..... | 222/478 |
| 2,099,292 | A * | 11/1937 | Brown | ..... | 222/478 |
| 2,727,644 | A * | 12/1955 | Giannos | ..... | 222/478 |
| 2,808,182 | A * | 10/1957 | Furedi | ..... | 222/479 |
| 2,825,495 | A * | 3/1958 | Fazio | ..... | 222/478 |
| 3,386,626 | A * | 6/1968 | Kearney | ..... | 222/147 |
| 4,596,341 | A * | 6/1986 | Bruffey | ..... | 220/705 |
| 5,002,209 | A * | 3/1991 | Goodall | ..... | 222/479 |
| 5,511,700 | A * | 4/1996 | Ouno | ..... | 222/481.5 |
| 6,609,639 | B1 * | 8/2003 | Genthon | ..... | 222/571 |
| 2005/0150910 | A1 * | 7/2005 | Groys | ..... | 222/189.11 |

* cited by examiner

*Primary Examiner* — Kevin P Shaver
*Assistant Examiner* — Michael J Melaragno
(74) *Attorney, Agent, or Firm* — RatnerPrestia

(57) ABSTRACT

A dispenser having a container for receiving a volume of food dressing, the dispenser comprising a tube extending between a first end portion having a first opening facing the internal space of the container and a second end portion having a distal end with a second opening facing the atmosphere such that the tube defines a passage between the first and second openings for allowing fluid communication between the internal space of the container and the atmosphere, wherein the tube has a first section extending from the first end portion and a second section ending at the distal end, wherein the passage has a first internal taper along the first section and the second section extends along a curve such that the distal end is generally parallel to the longitudinal axis, and wherein, after pouring, when the dispenser is moved back into an upright position by the user, the food dressing remaining in the passage flows back into the internal space of the container without dripping from the second end portion.

15 Claims, 6 Drawing Sheets

DISPENSER FOR FOOD DRESSING

CROSS REFERENCE TO RELATED APPLICATIONS

This application claims the benefit under 35 USC §119(e) of U.S. Provisional Patent Application 61/308,614 filed on Feb. 26, 2010. The contents of the above-mentioned patent application are incorporated herein by reference.

FIELD OF THE INVENTION

The present invention relates to a dispenser for dispensing food dressing that prevents the food dressing from dripping from the dispenser.

BACKGROUND OF THE INVENTION

Dispensers suitable for dispensing edible oils are known in the art. Typically, such dispensers are decorative and comprise a container for holding the oil and a spout through which the oil can be dispensed from the container.

A deficiency with existing oil dispensers is that after pouring they typically drip or leave a trail of oil running down the outer edge of the dispenser. More specifically, after pouring, once the user has returned the dispenser to an upright position, a trail of oil is left to drip down the outside edge of the spout. After numerous uses, a sufficient amount of oil has dripped down the edge of the spout to cause the body of the container to be covered in oil. This not only results in a waste of oil (which can be quite expensive depending on the quality of the oil) but also creates an unpleasant greasy coating on the outside of the dispenser which can cause a user's hands and fingers to become greasy and sticky.

In view of the above, it is clear that there is a need in the industry for an improved food dressing dispenser that alleviates at least in part the deficiencies of existing dispensers.

SUMMARY OF THE INVENTION

In accordance with a broad aspect, the present invention provides a dispenser for food dressing, the dispenser extending along a longitudinal axis and comprising: (a) a container defining an internal space for receiving a volume of the food dressing, the container having a rim defining an opening; and (b) a cap comprising an attachment portion for attaching the cap to the container for at least partially covering the opening of the rim and a tube extending between a first end portion having a first opening facing the internal space of the container and a second end portion having a distal end with a second opening facing the atmosphere such that the tube defines a passage between the first and second openings for allowing fluid communication between the internal space and the atmosphere, wherein the tube has a first section extending from the first end portion and a second section ending at the distal end, wherein the passage has a first internal taper along the first section and the second section extends along a curve such that the distal end is generally parallel to the longitudinal axis, and wherein, in use, when the dispenser is tilted by a user, the food dressing flows within the passage and is poured out of the second end portion of the tube, and when the dispenser is moved back into an upright position by the user, the food dressing remaining in the passage flows back into the internal space of the container without dripping from the second end portion.

The invention also provides a dispenser for food dressing, the dispenser extending along a longitudinal axis and comprising: (a) a container defining an internal space for receiving a volume of the food dressing, the container having a rim defining an opening; and (b) a cap comprising an external shell and an internal member, the external shell comprising a peripheral wall and a top wall defining an internal space and further comprising an attachment portion for attaching the shell to the container for at least partially covering the opening of the rim, the internal member being made of food grade silicone and comprising a tube extending between a first end portion having a first opening facing the internal space of the container and a second end portion having a distal end with a second opening facing the atmosphere such that the tube defines a passage between the first and second openings for allowing fluid communication between the internal space of the container and the atmosphere, wherein the tube has a first section extending from the first end portion and a second section ending at the distal end, wherein the passage has a first internal taper along the first section and the second section extends along a curve such that the distal end is generally parallel to the longitudinal axis, and wherein, in use, when the dispenser is tilted by a user, the food dressing flows within the passage and is poured out of the second end portion of the tube, and when the dispenser is moved back into an upright position by the user, the food dressing remaining in the passage flows back into the internal space of the container without dripping from the second end portion.

This and other aspects and features of the present invention will now become apparent to those of ordinary skill in the art upon review of the following description of embodiments of the invention in conjunction with the accompanying figures.

BRIEF DESCRIPTION OF THE DRAWINGS

A detailed description of examples of implementation of the present invention is provided hereinbelow with reference to the following drawings, in which.

Figure 1:
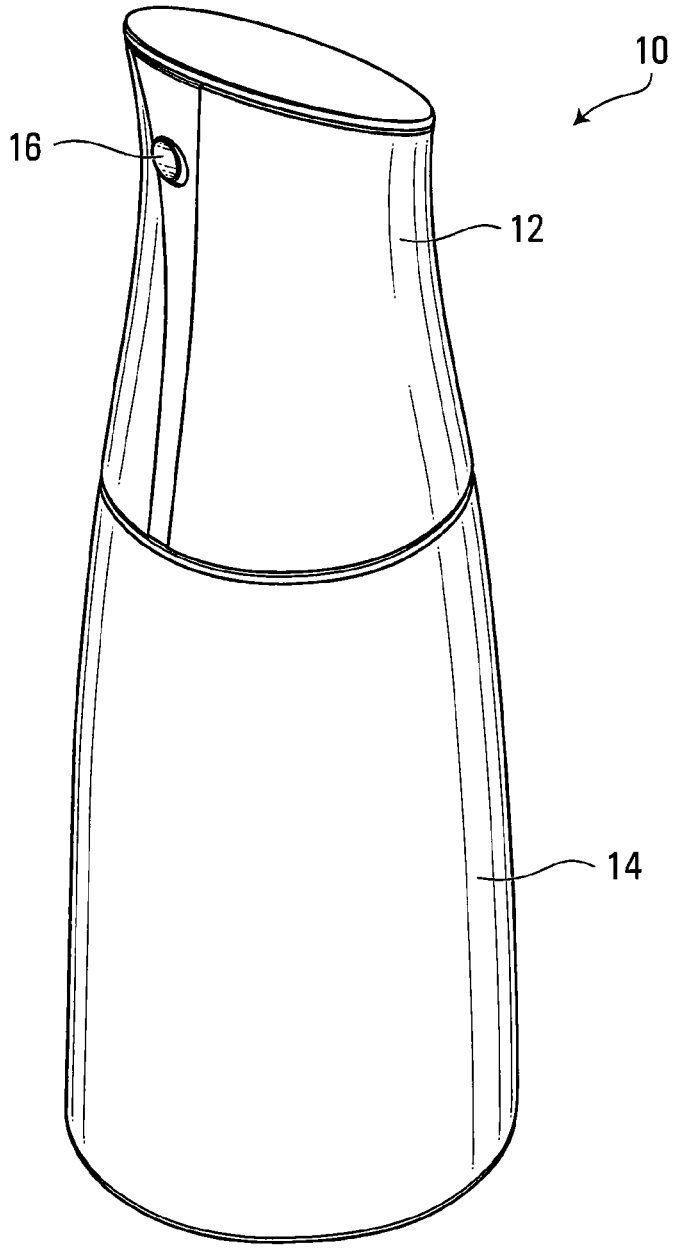
FIG. 1 shows a perspective view of a dispenser for food dressing, in accordance with a non-limiting embodiment of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF EMBODIMENTS

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

In the figures, a dispenser 10 for food dressing in accordance with a non-limiting embodiment of the present invention is shown. The dispenser 10 is suitable for dispensing food dressings, such as salad dressings, olive oil, oil and vinegar, oil mixed with vinegar and spices, food marinades, or any other type of edible food dressing.

Figure 2:
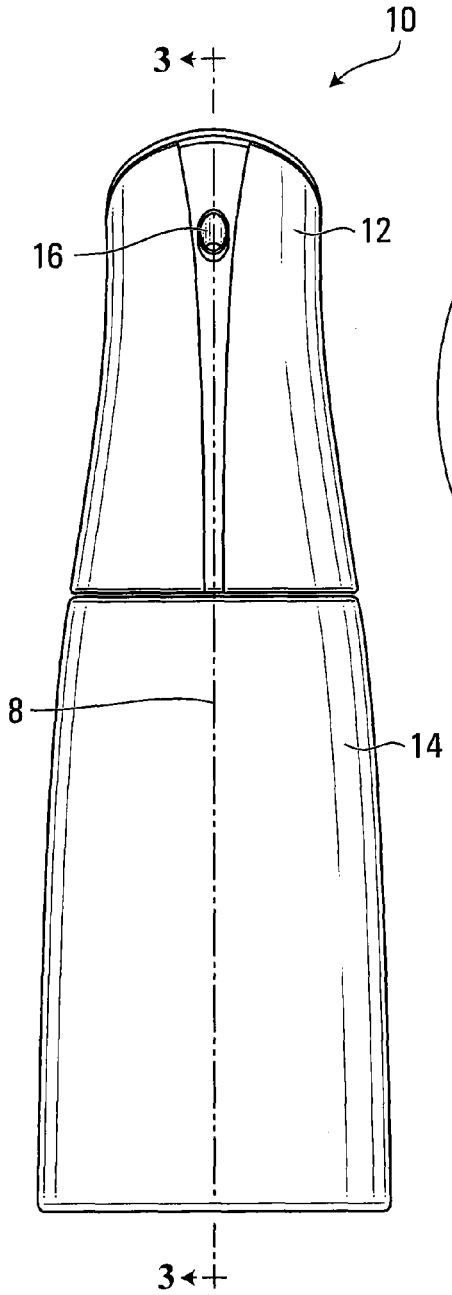
FIG. 2 shows a front view of the dispenser of FIG. 1.
Figure 3:
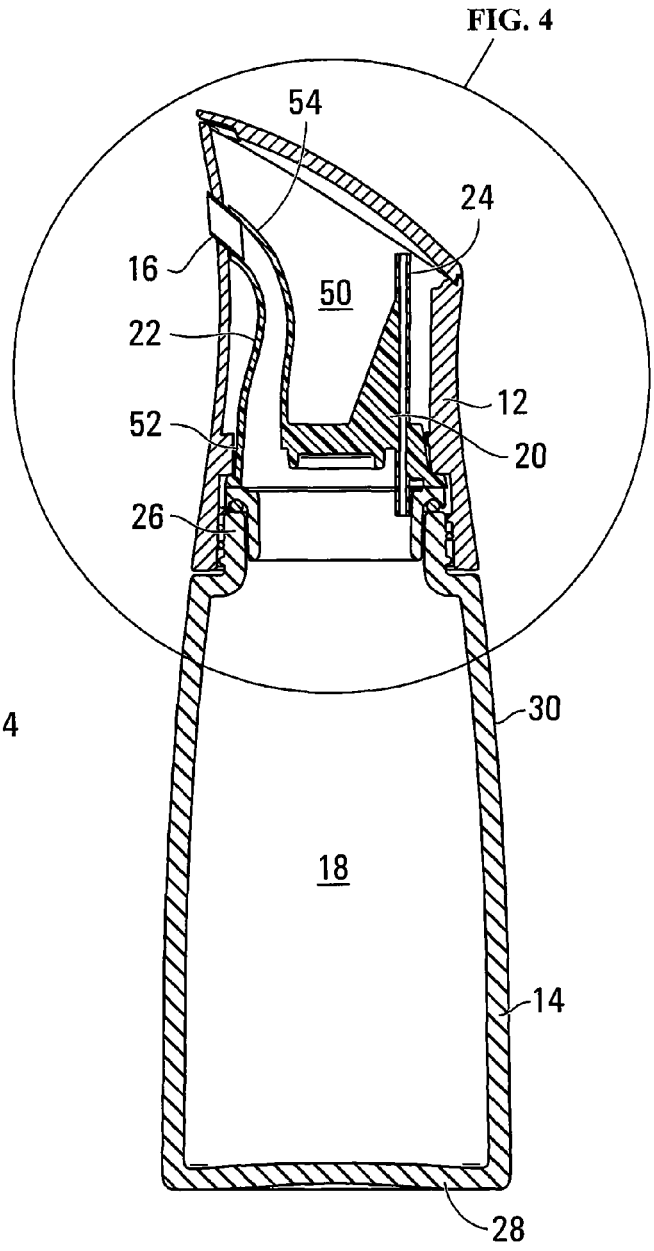
FIG. 3 shows a cross-sectional view of the dispenser taken along line 3-3 in FIG. 2.

The dispenser 10 comprises a cap 12 and a container 14 that together extend along a longitudinal axis identified by reference numeral 8 in FIG. 2. The container 14 further comprises a bottom wall 28 and a peripheral wall 30 that define an internal space 18 for receiving a volume of food dressing, and a rim 26 that defines an opening 27 such that food dressing can exit via the opening 27. The container 14 may be made of transparent plastic, glass, ceramic or stainless steel, among other possibilities.

The cap 12 comprises an attachment portion 34 for attaching the cap 12 to the container 14 for at least partially covering the opening 27. In the embodiment shown, the attachment portion 34 of the cap 12 comprises internal threads 36 for engaging with corresponding external threads 32 on the rim 26 of the container 14. In this manner, the cap 12 and container 14 can be removable attached together by screwing and unscrewing the cap 12 onto the container 14. Although in the embodiment depicted, the rim 26 comprises external threads 32 and the attachment portion 34 of the cap 12 comprises internal threads 36, the thread arrangement could be reversed such that it is the rim 26 that comprises the internal threads and the cap 12 that comprises the external threads. In addition, instead of comprising corresponding threads, the cap 12 and the container 14 could be attachable to one another via a friction fit or a snap-fit arrangement, among other possibilities.

Figure 4:
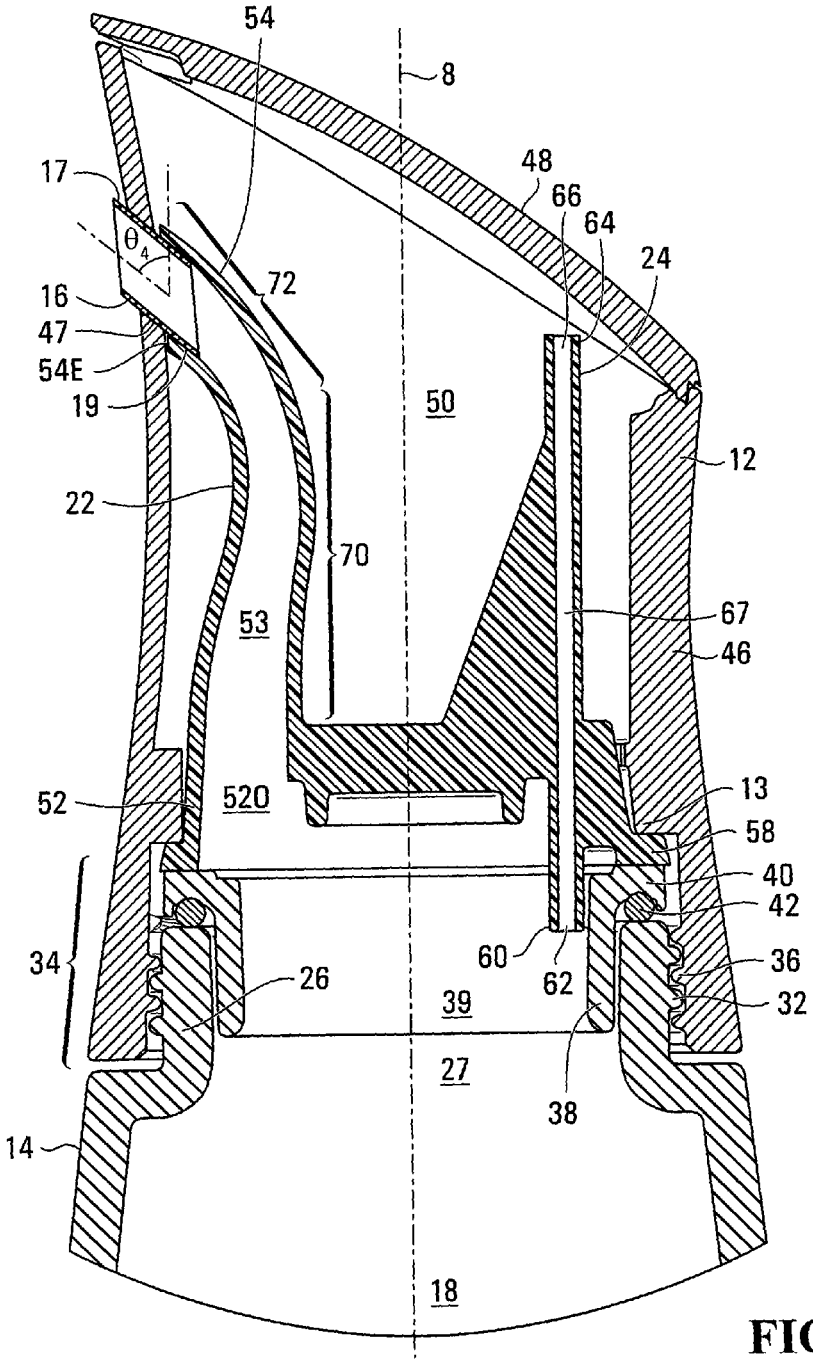
FIG. 4 shows an enlarged cross-sectional view of the top portion of the dispenser of FIG. 1.

As best shown in FIG. 4, the dispenser 10 further comprises a peripheral ring 38 that is positioned between the cap 12 and the container 14 when the cap 12 and the container 14 are attached together. The peripheral ring 38 has a portion that is located within the opening 27 and which defines an opening 39 for allowing flow of the food dressing through the openings 27, 39. The peripheral ring 38 also has a shoulder 40 projecting outwardly at its top end and which is located above the rim 26. A sealing member 42, which can be an O-ring or gasket, is positioned between the lower surface of the shoulder 40 of the peripheral ring 38 and the upper surface of the rim 26 in order to create a seal between the peripheral ring 38 and the container 14.

The cap 12 further comprises a peripheral wall 46 and a top wall 48 for forming an external shell. The external shell of the cap 12 may be made of aluminum, plastic or stainless steel, among other possible materials. Although the peripheral wall 46 and the top wall 48 are shown as being separate components in the figures, it should be appreciated that the peripheral wall 46 and the top wall 48 could be integrally formed via a molding process, for example. The cap 12 further comprises an aperture 47 in the peripheral wall 46, within which a spout 16 can be at least partially mounted. The spout 16 can be made of a material such as plastic or stainless steel, among other possibilities. The spout 16 has a distal end 17 and a proximal end 19 that are angled, such that when the spout 16 is inserted within the aperture 47 of the peripheral wall 46, the distal end 17 of the spout 16 form a plane that is generally parallel to the longitudinal axis 8 of the dispenser 10.

The peripheral wall 46 and the top wall 48 define an internal space 50 within which an internal member 20 is confined.

Figure 5:
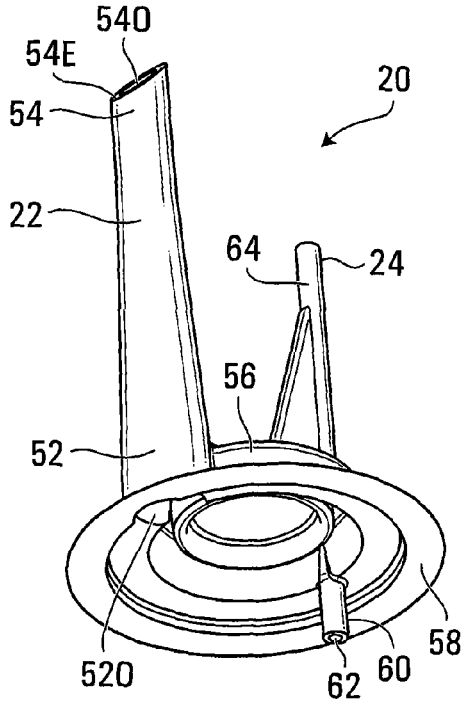
FIG. 5 shows a perspective view of an internal member according to the present invention.
Figure 6:
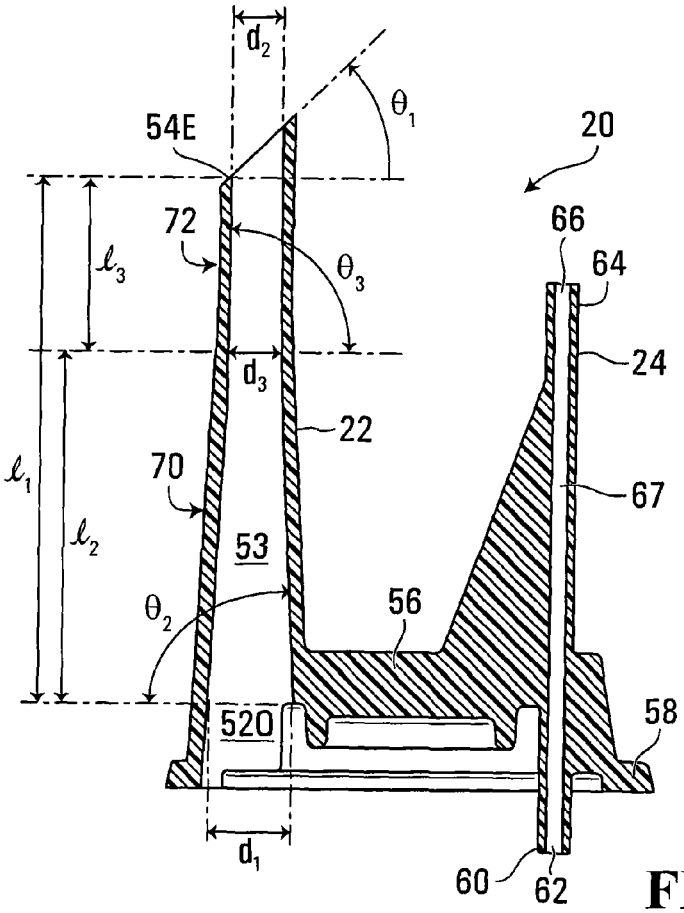
FIG. 6 shows a cross-sectional view of the internal member of FIG. 5.

As shown in FIGS. 4 to 6, the internal member 20 comprises a tube 22 that extends between a first end portion 52 having a first opening 520 facing the internal space 18 (when the cap 12 is attached to the container 14) and a second end portion 54 having a distal end 54E with a second opening 540 facing the atmosphere such that the tube 22 defines a passage 53 between the first and second openings 520, 540 for allowing fluid communication between the internal space 18 and the atmosphere via the passage 53 when the dispenser 10 is tilted by a user. The tube 22 may be confined within the internal space 50 of the shell and having its second end portion 54 engaging the proximal end 19 of the spout 16 such that only the distal end 17 of the spout 16 projects outside the peripheral wall 46 of the shell and the food dressing is poured out of the dispenser 10 via the spout 16.

As shown in FIG. 6, the tube 22 of the internal member 20 has a length $l_1$ with a first section 70 extending from the first end portion 52 and having a length $l_2$ and a second section 72 ending at the distal end 54E and having a length $l_3$.

The length $l_2$ of the first section 70 may be longer than the length $l_3$ of the second section 72. More specifically, the length $l_2$ of the first section 70 forms between 55-70% of the overall length $l_1$ of the tube 22, and the length $l_3$ of the second section 72 forms between 30-45% of the overall length $l_1$. For example, the length $l_1$ of the tube may be in the order of 1.80 to 2.10 inches, the length $l_2$ of the first section 70 may be in the order of 1.10 to 1.30 inches and the length $l_3$ of the second section may be in the order of 0.65 to 0.85 inches.

In accordance with an embodiment of the invention, the passage 53 along the first section 70 has an internal taper of between 1.5° and 5° and the second section 72 extends along a curve such that the distal end 54E is generally parallel to the longitudinal axis 8 (as best shown in FIG. 4). Referring to FIG. 6, the internal wall defining the passage 53 along the first section 70 extends along a line that defines an angle $\theta_2$ with a horizontal line. The angle $\theta_2$ may range between 85° and 88.5°.

In accordance with another embodiment, the passage 53 along the section 72 may also have a tapering shape and the passage 53 may also have a greater internal taper than the passage 53 along the second section 72. For example, the passage 53 along the second section 72 may have an internal taper of between 0.01° and 1.5° and its internal wall, when seen in FIG. 6, may extend along a line that defines an angle $\theta_3$ with a horizontal line. The angle $\theta_3$ may range between 89.99° and 88.5°. It is understood that as long as the angle $\theta_3$ is less than 90°, the passage 53 along the second section 72 has an internal taper.

In accordance with the present invention, the diameter of the passage 53 of the tube 22 may reduce gradually from the first end portion 52 to the second end portion 54. More specifically, the passage 53 has a first diameter $d_1$ at the first end portion 52 of the first section 70 and the passage 53 has a second diameter $d_2$ at the second end portion 54 of the second section 72 where there is a ratio between the second diameter $d_2$ and the first diameter $d_1$ of between 0.55 and 0.75 as a result of the internal tapering of the first and second sections 70, 72. The passage 53 also has an intermediate (third) diameter $d_3$ at the entry of the second section 72 where the ratio between third diameter $d_3$ and the first diameter $d_1$ is between 0.6 and 0.75 and the ratio between the second diameter $d_2$ and the third diameter $d_3$ is between 0.91 and 0.99.

For the sake of example, the first diameter $d_1$ at the entry of the second section 70 (near the first end portion 52) may be between 0.285 inches and 0.295 (advantageously around 0.290 inches), the third (intermediate) diameter $d_3$ at the entry to the second section 72 may be between 0.195 inches and 0.205 (advantageously around 0.200 inches) and the second diameter $d_2$ at the exit of the second section 72 (distal end 54E) may be between of 0.185 inches and 0.195 inches (advantageously around 0.190 inches). As such, the diameter of the passage 53 of the tube 22 may reduce by 60% to 85% between the first end portion 52 and the second end portion 54.

The internal member 20 may be removable from the cap 12, such that it can be taken out of the cap 12 to be cleaned or replaced. The internal member 20 can be made of an elastomeric material, such as food grade silicone, among other possible materials.

The internal member 20 comprises the tube 22 having the first end portion 52, the second end portion 54 and the passage 53 for pouring the food dressing out of the second end portion 54 that is open to the atmosphere. The internal member 20 further comprises an aeration tube 24 for enabling air from the atmosphere to enter the internal space 18. The aeration tube 24 comprises a first end 60 defining a first opening 62 facing the internal space 18 of the container 14 and a second end 64 defining a second opening 66 facing the internal space 50 of the external shell of the cap 12. The aeration tube 24 thus defines an air passage 67 between the internal space 18 of the container and the internal space 50 of the external shell that, in use, when food dressing is dispensed through the passage 53 of the tube 22, allows air to penetrate into the internal space 18 of the container 14 in order to replace the volume of food dressing being dispensed out. As a result, food dressing can dispense out through the passage 53 of the tube 22 smoothly, without the risk of bubbles interrupting the flow.

The internal member 20 further comprises a central wall portion 56 and an outer rim 58. The central wall portion 56 forms a type of cap and the outer rim 58 is pressed against the shoulder 40 when the cap 12 is attached to the container 14 for preventing the food dressing within the internal space 18.

When the cap 12 has been attached to the container 14, the internal peripheral shoulder 13 of the cap 12 press against the outer rim 58 that is pushed against the upper surface of the shoulder 40 such that the outer rim 58 sealingly engages with the shoulder 40 in order to create a seal between the member 20 and the peripheral ring 38 such that food dressing can only flow through the opening 27 of the container 14, the opening 39 of the peripheral ring 38, enter in the passage 53 of the tube 22, flow in the passage 53 and exit the tube 22 at the upper end portion 54 (through the spout 16) when the dispenser 10 is tilted.

As indicated previously, the dispenser also has a sealing member 42 in order to create a seal between the peripheral ring 38 and the container 14. The sealing member 42 and the pressing of the outer rim 58 against the shoulder 40 therefore prevent the food dressing from leaking between the container 14 and the peripheral ring 38 and between the peripheral ring 38 and the internal member 20. In the case where the dispenser 10 does not include the peripheral ring 38, the outer rim 58 of the internal member 20 would be pressed on the upper surface of the rim 26 of the container 14 so as to sealingly engage the rim 26 in order to create a seal between the internal member 20 and the container 14.

As best shown in FIGS. 4 and 6, the distal end 54E of the second end portion 54 has an angle $\theta_1$ of between approximately 40° and 50°, and preferably 45°, such that the distal end 54E is generally parallel to the longitudinal axis 8 when the distal end 54E is mounted around the proximal end 19 of the spout 16. The portion of the second end portion 54 that engages the spout 16 and the spout 16 both extend along a line defining an angle $\theta_4$ of approximately 40° to 50° about the a line parallel to the longitudinal axis 8. The second end portion 54 may engage with the spout 16 by being placed around the proximal end 19 of the spout 16, or by being placed within the passage of the spout 16. The engagement between the spout 16 and the second end portion 54 of the tube is generally created via a friction fit.

Figure 7:
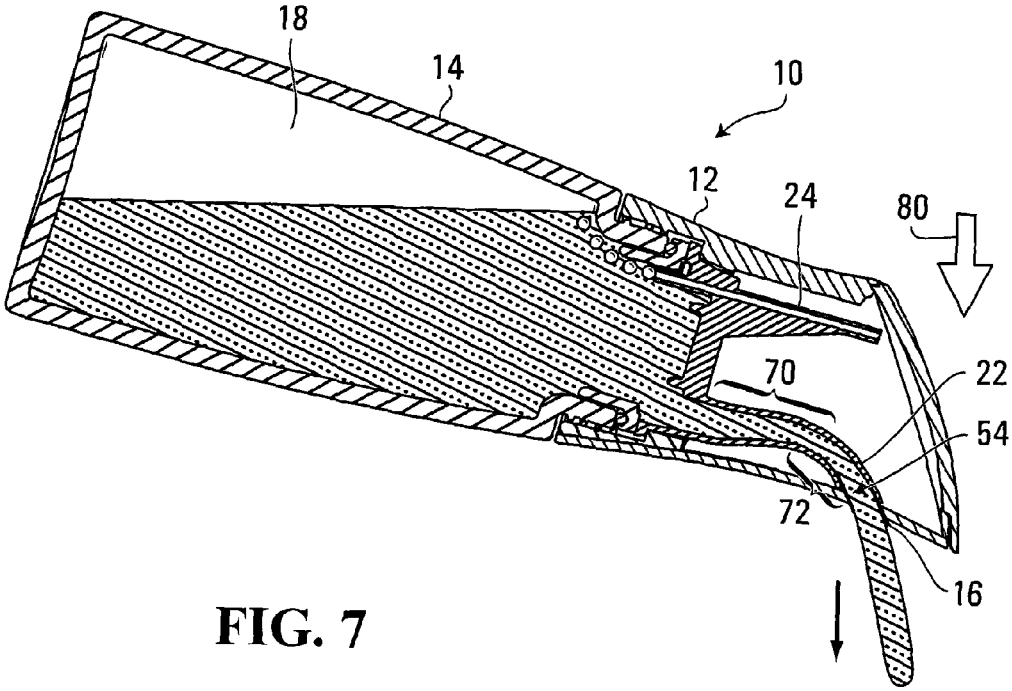
FIGS. 7 to 10 show cross-sectional side views of the dispenser of FIG. 1 at various stages of a dressing pouring process.

The functioning of the dispenser 10 according to the present invention will now be described in more detail with respect to FIGS. 7 through 10. In FIG. 7, the dispenser 10 has been tilted downwardly in a direction indicated by arrow 80 into a pouring position. In this pouring position, the food dressing that is stored within the internal space 18 can be pour from the internal space 18, flow through the openings 27, 39, flow through the passage 53 along the first and second sections 70, 72 of the tube 22 and is poured out of the second end portion 54 (or spout 16 when a spout is located within the second end portion 54).

Figure 8:
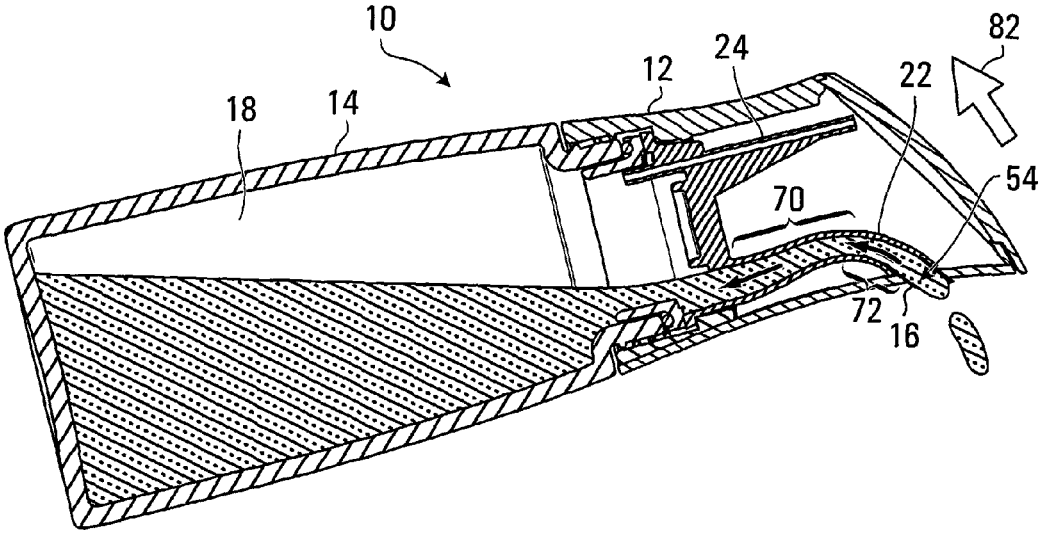
Figure 9:
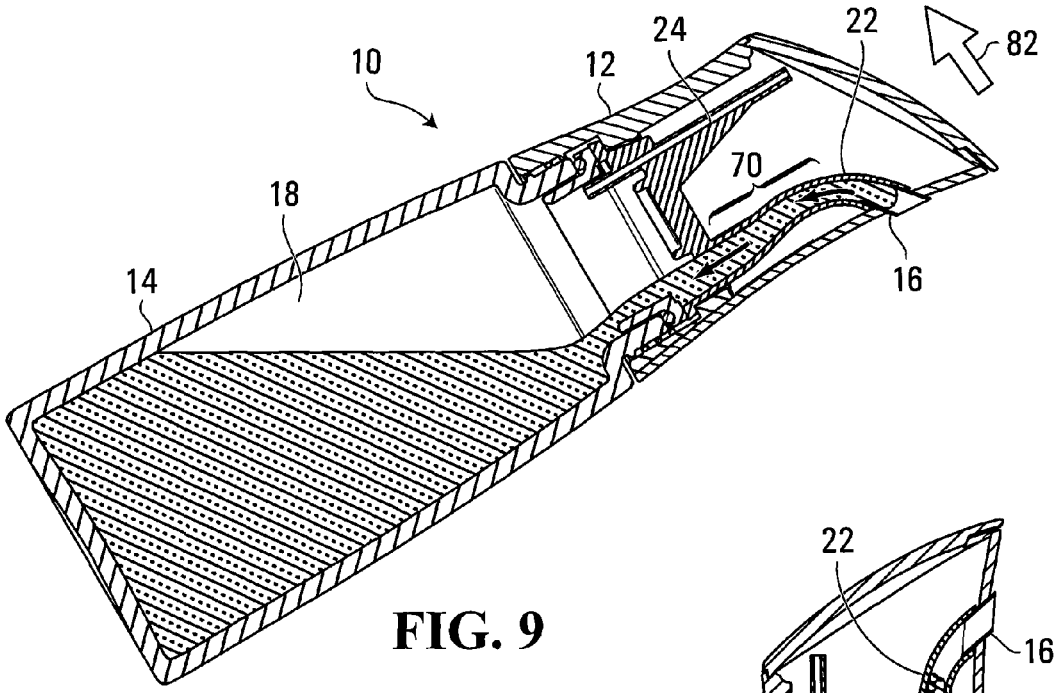

In FIGS. 8 and 9, the dispenser 10 is tilted in substantially the reverse direction indicated by arrows 82, in order to move the dispenser 10 back into an upright position. As the dispenser 10 is tilted in this direction, the flow of the food dressing from the second end portion 54 (spout 16) is interrupted (as depicted in FIG. 8) and the food dressing starts to flow back through the passage 53 into the internal space 18.

Figure 10:
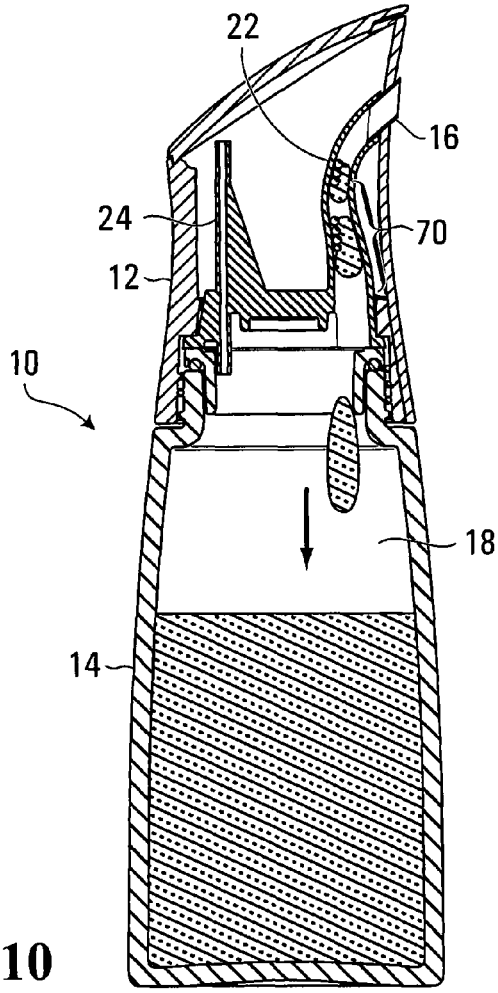

Finally, in FIG. 10, once the dispenser 10 is back in the upright position, any food dressing remaining in the passage 53 flows back into the internal space 18.

As depicted in FIGS. 9 and 10, as the dispenser 10 is moved back into the upright position, the food dressing contained in the passage 53 does not drip down out of the second end portion (spout 16) or leave a trail running down the outside surface of the cap 12. Instead, there is a relatively clean interruption of the flow of food dressing that is poured out of the second end portion 54 (spout 16), such that the remaining food dressing is drawn back into the internal space 18. As a result, the dispenser 10 is a substantially drip-free pouring dispenser.

In a venturi tube, the fluid, the food dressing in this case, that flows within the narrower, more constricted area of the tube passage flows at a higher velocity and a lower pressure than the fluid that flows within the wider, less constricted area of the tube passage. Without wishing to be bound by the following explanations, it is believed that due to the different internal tapers of the passage 53 along the first and second sections 70, 72 of the tube 22, the forces on the food dressing that result from the shape and configuration of the tube 22 and passage 53, cause the food dressing remaining in the passage 53 at the second section 72 to flow back into the internal space 18 without dripping from the second end portion 54 (or spout 16) when the dispenser 10 is moved back by the user into an upright position.

More particularly, the tapering shape of the passage 53 along the first section 70 of the tube 22 creates a type of venturi tube effect at the entry of the second section 72 when the food dressing is poured out. The area of the passage 53 near the entry of the second section 72 is therefore at a lower pressure. When the dispenser 10 is moved back into an upright position after pouring, the pressure differential exerted on the food dressing as a result of the tapering shape of the passage 53 along the first section 70 causes the food dressing remaining in the passage 53 at the second section 72, which is still at that point at a lower pressure near the entry of the second section 72, to flow back into the internal space 18 without dripping from the second end portion 54 (or spout 16) as the dispenser 10 is returned to an upright position. While the tube 22 has a passage 53 with a first internal taper along the first section 70 and a second internal taper along the second section 72, it is believed that a tube with a curved distal end portion with a end face parallel to the longitudinal axis of the dispenser and a passage with an internal taper along the length of the tube would create forces on the food dressing causing the food dressing remaining in the passage to flow back into the internal space of the container without dripping from the distal end portion when the dispenser is moved back by the user into an upright position. Food dressings such as olive oil have relatively long chains of carbon molecules, which create relatively strong intermolecular forces. Many food dressings further comprise high viscosities. For example, the viscosity of olive oil is in the order of 84 cPoise. The strong intermolecular forces, together with the narrowing of the internal diameter of the passage 53 of the tube 22 may further help to draw the food dressing remaining in the passage 53 back into the internal space 18 of the container 14 once the pouring of the food dressing is complete and the user moves back the dispenser 10 into the upright position.

Moreover, because the second section 72 extends along a curve such that the distal end 54E is generally parallel to the longitudinal axis 8, and because of the capillary action between the food dressing and the internal wall of the passage 53 of the tube 22, which is made of food grade silicone, the food dressing is caused to be pulled back into the tube 22, as opposed to dripping out of the second end portion 54 (spout 16). Also, when the user stops pouring and moves back the dispenser 10 into the upright position, air bubbles can be present in the food dressing at the upper surface of the internal wall of the passage 53 along the second section 72 and these air bubbles may facilitate to draw the food dressing back into the internal space 18 of the container 14.

Furthermore, providing that air bubbles are present in the food dressing remaining in the passage 53 at the second section 72, and providing that food dressing is separated in several drops due to the viscosity of the food dressing and the higher pressure in the passage 53 at the section 70, these air bubbles and this separation of the food dressing in several drops may facilitate to draw of any remaining drops in the passage 53 at the second section 72 back into the internal space 18 of the container 14.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A dispenser for food dressing, said dispenser extending along a longitudinal axis and comprising:

(a) a container defining an internal space for receiving a volume of the food dressing, said container having a bottom wall and a rim defining an opening;

(b) an external shell comprising a peripheral wall and a top wall defining an internal space and further comprising an attachment portion for attaching said external shell to said container for at least partially covering said opening of said rim, said peripheral wall of said external shell having an aperture;

(c) a spout at least partially mounted in said aperture of said peripheral wall of said external shell, said spout having a proximal end located in said external shell and a distal end with an opening facing the atmosphere, said distal end projecting outside said external shell and said opening being within a first imaginary plan generally parallel to said longitudinal axis; and (d) an internal member enclosed within said external shell, said internal member being made of food grade silicone and comprising an integral tube extending between a first end having a first opening facing said internal space of said container and a second end with a distal end portion having a second opening for facing the atmosphere such that said integral tube defines a passage between said first and second openings for allowing fluid communication between said internal space of said container and the atmosphere;

wherein, said integral tube has a first section extending from its first end and a second section ending at its distal end, said first section having a proximal end portion being within a second imaginary plan parallel to said longitudinal axis such that said first opening faces said bottom wall of said container, said second section extending along a curve and towards said peripheral wall of said external shell such that said distal end portion of said integral tube is mounted around said proximal end of said spout;

wherein said passage has a first internal taper along said first section such that, in use, when said dispenser is tilted by a user, the food dressing flows within said passage and is poured out of said second end of said integral tube through said spout, and when said dispenser is moved back into an upright position by the user, the food dressing remaining in said passage flows back into said internal space of said container without dripping from said distal end of said spout.

2. A dispenser as defined in claim 1, wherein said first taper is between 1.5° and 5° and said passage has a second internal taper of between 0.01° and 1.5° along said second section.

3. A dispenser as defined in claim 2, wherein said first section has a greater length than said second section.

4. A dispenser as defined in claim 3, wherein said passage has a first diameter at said first end and a second diameter at said second end where a ratio between said second diameter and said first diameter is between 0.55 and 0.75.

5. A dispenser as defined in claim 4, wherein said passage has an intermediate diameter at an entry of said second section where a ratio between said intermediate diameter and said first diameter is between 0.6 and 0.75 and a ratio between said second diameter and said intermediate diameter is between 0.91 and 0.99.

6. A dispenser as defined in claim 5, wherein said first diameter is between 0.285 inches and 0.295, said intermediate diameter is between 0.195 inches and 0.205 and said second diameter is between of 0.185 inches and 0.195 inches.

7. A dispenser as defined in claim 3, wherein said first section forms between 55% and 70% of said length of said integral tube and said second section forms between 30% and 45% of said length of said integral tube.

8. A dispenser as defined in claim 3, wherein said first section has a first length of between 1.10 inches and 1.30 inches and said second section has a second length of between 0.65 inches and 0.85 inches.

9. A dispenser as defined in claim 1, wherein said spout is made of aluminum, plastic or stainless steel.

10. A dispenser as defined in claim 1, wherein said internal member is removable from said external shell.

11. A dispenser as defined in claim 1, wherein said internal member further comprises an integral aeration tube having a first end with a first opening facing said bottom wall of said container and a second end with a second opening facing said internal space of said external shell such that said integral aeration tube defines an air passage between said internal space of said container and said internal space of said external shell.

12. A dispenser as defined in claim 1, wherein said external shell further comprises an internal peripheral shoulder and said internal member further comprises an integral outer rim and wherein said internal peripheral shoulder of said external shell engages said integral outer rim of said internal member such that said integral outer rim of said internal member sealingly engages with said rim of said container.

13. A dispenser as defined in claim 12, further comprising a sealing member located between said integral outer rim of said internal member and said rim of said container.

14. A dispenser as defined in claim 1, wherein said external shell further comprises an internal peripheral shoulder, said internal member further comprises an integral outer rim and said dispenser further comprises a peripheral ring having a shoulder located between said integral outer rim of said internal member and said rim of said container, and wherein said internal peripheral shoulder of said external shell engages said integral outer rim of said internal member such that said integral outer rim of said internal member sealingly engages with said shoulder of said peripheral ring.

15. A dispenser as defined in claim 14, further comprising a sealing member located between said shoulder of said peripheral ring and said rim of said container.

* * * * *